US006314967B1

(12) United States Patent
Castells Ribas

(10) Patent No.: US 6,314,967 B1
(45) Date of Patent: Nov. 13, 2001

(54) BRUSH FOR APPLICATION OF MASCARA ON EYELASHES

(75) Inventor: Luis Castells Ribas, Barcelona (ES)

(73) Assignee: Techpack Espana, S.L., Barcelona (ES)

( * ) Notice: Subject to any disclaimer, the term of this patent is extended or adjusted under 35 U.S.C. 154(b) by 0 days.

(21) Appl. No.: 09/559,058

(22) Filed: Apr. 28, 2000

(30) Foreign Application Priority Data

May 25, 1999 (ES) ..... 9901115

(51) Int. Cl.[7] ..... A45D 40/30; A45D 40/26; A45D 40/24; A45D 44/18

(52) U.S. Cl. ..... 132/218; 132/317; 132/313; 132/216

(58) Field of Search ..... 132/218, 216, 132/217, 317, 320, 313; 401/129

(56) References Cited

U.S. PATENT DOCUMENTS 3,965,664 * 6/1976 Goetti et al. ..... 57/157

5,765,573 * 6/1998 Guest ..... 132/218

* cited by examiner

*Primary Examiner*—John J. Wilson
*Assistant Examiner*—Robyn Kieu Doan
(74) *Attorney, Agent, or Firm*—Dennison, Scheiner, Schultz & Wakeman

(57) ABSTRACT

This invention relates to a brush conventionally based on a metal wire (1) folded on itself and twisted in a spiral to form an attachment core (6) for fiber tufts forming the brush itself, the main characteristics being that it includes two types of fibers, namely plastic fibers (4) for example made of nylon, and vegetable fibers (5) for example made of cotton, linen or the like. The tufts of both types fibers (4–5) are laid out alternately such that the vegetable fibers (5) "stock" the makeup product, thus facilitating impregnation of the plastic fibers (4) when these plastic fibers come into contact with the user's eyelashes, making it possible to apply the mascara in a single pass.

8 Claims, 1 Drawing Sheet

BRUSH FOR APPLICATION OF MASCARA ON EYELASHES

Figure 4:
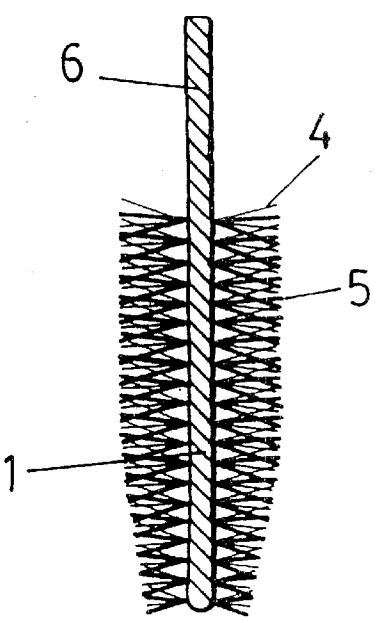

This invention relates to a brush for use in applying makeup on eyelashes, more precisely a brush impregnated with a product that will subsequently be applied on eyelashes so that mascara is applied to them to make them more esthetic.

This invention relates to a brush for applying mascara under optimum conditions, more precisely by a single application on eyelashes based on structural characteristics that induce better absorption of the makeup product used.

Conventional brushes used to apply mascara on eyelashes are traditionally structured using relatively long tufts of fibers arranged helically around a support or core composed of a twisted metal wire.

More precisely, these brushes are usually manufactured using relatively ductile fibers appropriate for making up something as delicate as eyelashes, usually made of different variants of nylon, taking advantage of the moisture absorption property of this material.

Furthermore, as everyone knows, the brush is used by dipping it into a receptacle containing the makeup and moving it over a wiper which is designed to leave the necessary quantity of mascara uniformly distributed on the brush so that a uniform quantity of the said product is applied on the eyelashes.

However, due to the nature of the fibers used, this operation does not guarantee that the product will be satisfactorily distributed over the entire brush since the said fibers bend in the direction of the brush centerline due to the proximity of the fibers and their flexibility, with the result that a concentration of the product is created within the said brush greater than the quantity of the product retained by the fibers in the part of the said fibers that come into contact with the eyelashes.

Consequently, the user finds difficult to obtain a good result with a single pass, and needs to make repeated applications.

There are several solutions on the market for solving this problem based on consistency between various parameters such as the diameter of the fiber used, different types of fiber cross-section, and miscellaneous surface finishes (smooth or with longitudinal slits parallel to the axis of the fiber, a variable number of fibers in the tufts, different diameters of metal wire, different numbers of turns in the helical part of the brush, etc.)

In practice, the use of fibers with longitudinal slits along their surface parallel to the axis of the said fibers is designed such that the product fills these slits, thus forming a sort of "stock" in which the product is retained in the area located close to the free end of the tufts, where the fibers come into contact with the user's eyelashes.

However, the results obtained in this case are really not satisfactory, which is why repeated applications are necessary to obtain a satisfactory result, as mentioned above.

The brush according to this invention solves the problem mentioned above satisfactorily by enabling application of the product under optimum conditions, and consequently makeup can be applied to the eyelashes in a single application.

Consequently and more precisely, starting from a structure similar to the structure of a conventional brush, in other words based on tufts of fibers laid out helically around a core or support composed of a twisted steel wire, the characteristics of the above mentioned brush are based on the fact that the said fibers consist of a combination of plastic fibers and vegetable fibers, preferably made of cotton, linen or the like, and satisfactorily distributed.

Vegetable fibers are added to the brush so that they can act as a depository for the mascara by making use of their absorption capacity, and also act as spacers for the plastic fibers since they are located in the spaces between the plastic fibers, so that the spacing between plastic fibers is more than usual. Thus, in addition to being made up, the eyelashes are also combed at the same time, consequently each plastic fiber is supplied with mascara by the adjacent vegetable fibers resulting in a better application of the product on the eyelashes.

The plastic fibers used may have any of the characteristics used in conventional brushes, such as a smooth, solid or hollow outside surface, longitudinal slits being formed in the outside surface, and also preferably the diameter must be of the order of 0.17 mm whereas the maximum diameter of the vegetable fibers (preferably cotton, linen or the like) will be of the order of 0.6 mm and may be composed of 1 or several pieces.

Furthermore, the proportion of vegetable fibers in the general context of the brush, in other words compared with the total number of fibers, may be between 10 and 50%.

Finally, the diameter of the metal wire forming the core of the brush and the fiber attachment element, should also preferably be between 0.50 and 0.75 mm and the pitch of the spiral formed by the fiber is between 1 and 2 mm.

Figure 1:
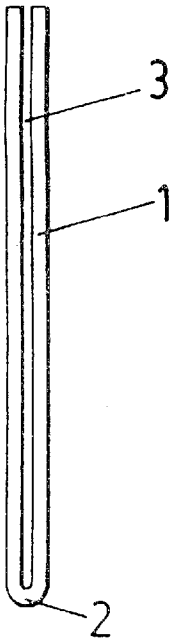

The attached set of drawings is provided for illustration purposes in order to complete the description and make it easier to understand the characteristics of the invention in accordance with one preferred embodiment, and these drawings form an integral part of this description, although they are in no way limitative:

FIG. 1 diagrammatically shows a side view of the metal wire that will form the core of the brush, once folded back on itself to hold the fiber tufts in it.

Figure 2:
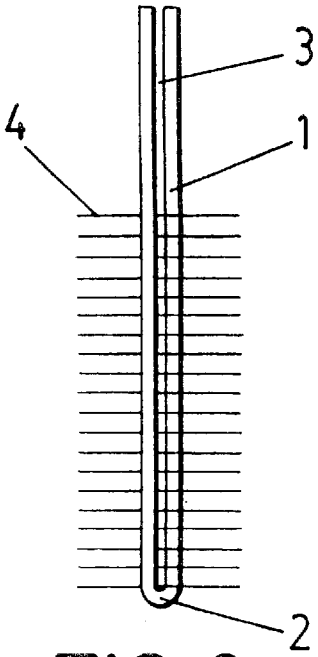

FIG. 2 is similar to FIG. 1, but shows the plastic fibers on the wire or core of the brush.

Figure 3:
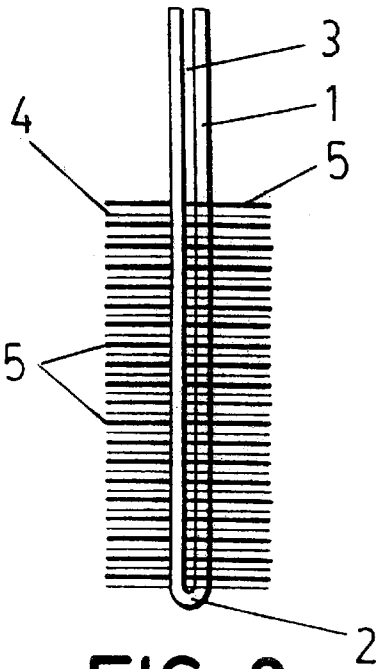

FIG. 3, like the previous Figures, shows the same assembly as FIG. 2 after the vegetable fibers have been added.

FIG. 4, like the previous Figures, shows the completely finished brush, after having twisted the metal wire and trimming the fibers to obtain the required overall shape of the brush.

These Figures clearly show that the brush designed to apply mascara on eyelashes proposed by the invention is composed of a single wire element 1 with an appropriate length and a diameter between 0.5 and 0.75 mm, folded onto itself at its mid-point 2, thus forming a groove 3 in which the fiber tufts must be inserted, namely a set of plastic fiber tufts 4, for example made of nylon, and a set of vegetable fiber tufts 5, for example made of cotton, the diameter of the plastic tufts being 0.17 mm and the diameter of the vegetable fiber tufts being 0.6 mm.

As mentioned above, the plastic fibers 4 may be solid or hollow and their surface may be smooth or grooved, whereas the vegetable fibers 5 may be structured with one or several ends.

In all cases, and after determining an appropriate arrangement of fibers 4–5 in accordance with the alternating arrangement mentioned above, the said metal wire must be twisted along the length of the groove 3 of this said metal wire 1 forming the core of the brush as shown in FIG. 4, to form a brush handle 6 and also an attachment and retaining means for the fibers 4–5, the brush itself being trimmed to form a cylindrical section and a frusto-conical section within the brush, also as shown in FIG. 4 mentioned above.

Although the proportion of vegetable fibers is 50% in the example of a practical embodiment shown in the Figures, in other words there is one tuft of vegetable fibers 5 for one tuft of plastic fibers 4, in practice this proportion may be lower if necessary, with the proportion of vegetable fibers being equal to at least 10%.

Secondly, the pitch of the spiral defined by the tufts of fibers 4–5 when the wire 1 is being twisted may be between 1 and 2 mm.

What is claimed is:

1. A mascara brush, comprising:

a central core including first and second metal wire segments;

a plurality of plastic fibers and a plurality of vegetable fibers distributed along the length of said first and said second segments of metal wire, said segments being formed into a double helix such that said fibers are held between said first and second segments and extend uniformly and radially from said segments in a helix.

2. The mascara brush of claim 1, wherein the proportion of the number of vegetable fibers (5) to the sum of the number of vegetable fibers and plastic fibers is between 10 and 50%.

3. The mascara brush of claim 1, wherein each of said plurality of plastic fibers (4) is solid, wherein each of said plurality of plastic fibers has a smooth outside surface, and wherein the diameter of each of said plurality of plastic fibers is about 0.17 mm.

4. The mascara brush of claim 1, wherein the plurality of vegetable fibers (5) are selected from the group consisting of cotton and linen, wherein each of said plurality of vegetable fibers has a maximum diameter of 0.6 mm; and wherein each of said plurality of vegetable fibers includes one or several ends.

5. The mascara brush of claim 1, wherein the first metal wire segment (1) has a diameter of between 0.50 and 0.75 mm, and wherein the pitch of the double helix is between 1 and 2 mm.

6. The mascara brush of claim 1, wherein each of said plurality of plastic fibers (4) is hollow and wherein each of said plurality of plastic fibers has a smooth outside surface, and wherein the diameter of each of said plurality of plastic fibers is about 0.17 mm.

7. The mascara brush of claim 1, wherein each of said plurality of plastic fibers (4) is hollow and wherein each of said plurality of plastic fibers has a grooved outside surface, and wherein the diameter of each of said plurality of plastic fibers is about 0.17 mm. 7.

8. The mascara brush of claim 1, wherein each of said plurality of plastic fibers (4) is solid and wherein each of said plurality of plastic fibers has a grooved outside surface, and wherein the diameter of each of said plurality of plastic fibers is about 0.17 mm.

* * * * *